United States Patent [19]

Orenstein

[11] 4,291,488

[45] Sep. 29, 1981

[54] HOPPITY TOY SYSTEMS

[76] Inventor: Henry Orenstein, 136 Lakeside Ave., Verona, N.J. 07044

[21] Appl. No.: 148,951

[22] Filed: May 12, 1980

[51] Int. Cl.[3] ..... A63H 13/00

[52] U.S. Cl. ..... 46/116; 46/12

[58] Field of Search ..... 46/116, 43, 202, 12, 46/1 K, 257, 260, 122

[56] References Cited

U.S. PATENT DOCUMENTS 3,281,985 11/1966 Einfalt ..... 46/202

4,109,410 8/1978 Saito ..... 46/202 X 4,128,964 12/1978 Ogasawara ..... 46/202 X

*Primary Examiner*—Gene Mancene

*Assistant Examiner*—Mickey Yu

*Attorney, Agent, or Firm*—George E. Kersey

[57] ABSTRACT

Hoppity toy systems formed by the combination of a hoppity toy with a variety of mechanical devices, such as an elevator and other moveable objects. The hoppity toy is directed by a track which confines the hopping motion to a prescribed route that includes a hoppity toy operable device.

6 Claims, 4 Drawing Figures

HOPPITY TOY SYSTEMS

BACKGROUND OF THE INVENTION

This invention relates to toy systems which employ hoppity figures, and, more particularly, to toy systems in which a moveable object is activatable by a hoppity figure.

Hoppity toys are well known in the art. The typical hoppity toy is formed by a wind-up figure which is counter-balanced with respect to the winding spring so that upon winding, the feet of the toy serve as a stop for preventing release of the energy stored in the spring. However, when the toy is placed on its feet, the counter-balance causes the rotation of the principal mass of the toy about its axis, so that the block against the stored energy of the spring is released, permitting the figure to hop about until the stored energy of the spring has been expended.

The hoppity motion exhibited by such a toy serves as an amusing diversion. However, the hopping motion tends to be random and uncontrolled. While the uncontrolled random motion of the hopping figure can serve as a source of amusement, the user tires of it in time.

Accordingly, it is an object of the invention to enhance the amusement appeal of hopping toy figures. A related object is to use a hopping toy figure to activate various accessory devices.

SUMMARY OF THE INVENTION

In accomplishing the foregoing and related objects, the invention provides for using a hoppity toy figure in conjunction with a guide channel that directs the forward motion of the energized hopping figure in a prescribed way. The hopping motion may be provided by a counter-balanced wind-up toy of conventional construction. Alternatively, the hopping motion may be provided by an energized toy which makes use of power sources such as batteries.

The guide channel advantageously is a track which confines the locomotive appendages of the toy figure to a prescribed path.

In accordance with one aspect of the invention, the hopping figure can have its forward motion channelled into an auxiliary toy which is manipulated by the hopping figure.

Thus the hopping figure can be channelled by a track into a cage of an elevator, with the hopping figure actuating a restraining lever to release the elevator cage and permit it to descend to a prescribed level. There the restraining lever can be pivoted out of contact with the toy figure to permit the figure to hop from the cage into, for example, a waiting vehicle.

DESCRIPTION OF THE DRAWINGS

Other aspects of the invention will become apparent after considering several illustrative embodiments, taken in conjunction with the drawings in which.

DETAILED DESCRIPTION

Figure 1:
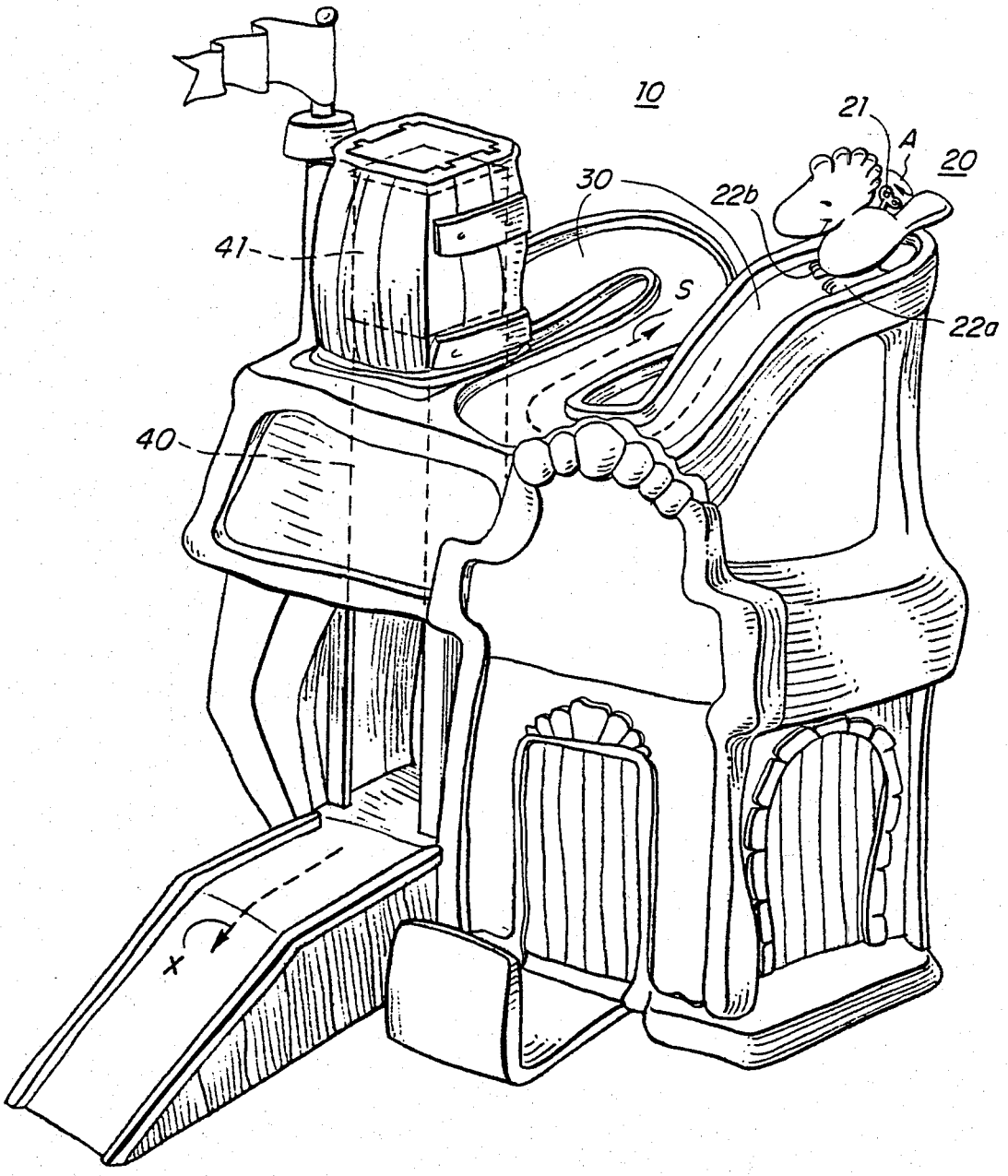
FIG. 1 is a perspective view of a toy system operated by a hopping figure in accordance with the invention.

Turning to the drawings, a toy system 10 which is operated by a hoppity figure 20 in accordance with the invention is shown in FIG. 1.

The particular system 10 of FIG. 1 is formed by a hopping figure 20 which acts upon a guide structure 30 and operates a suitable accessory such as an elevator 40. It will be understood that the system environment is merely illustrative and that the hopping figure 20 may be employed in conjunction with a wide variety of structural devices and guided figures in accordance with the invention.

The particular hopping figure 20 of the FIG. 1 is shown at one end of the guide structure 30 at an upper level of the overall structure 10 for guiding the hopping figure 20 into an elevator cage 41 (in phantom in FIG. 1) of the structure 40.

The particular hoppity figure 20 is of a conventional counter-balanced wind-up type in which the wind-up motion of a key 21 in the direction indicated by arrow A, causes the storage of energy in a spring. Each turn of the key 21 advances a ratchet gear with respect to a ratchet in conventional fashion in order to prevent release of the spring. In the case of a hoppity toy 20 of the kind shown in FIG. 1, the ratchet is connected to locomotive appendages, e.g., the feet **22*a* and 22*b*, which act as a restraining ratchet lever until the toy figure 20 is positioned on its feet, whereupon the counter-balance effect with respect to the feet releases the ratchet momentarily and consequently some of the stored energy of the spring. The result is that the figure 20** is able to undertake a random hopping motion which is terminated when the energy stored in its internal spring has been fully expended.

The invention provides for channelling and directing the hopping motion. In particular, as indicated in FIG. 1, the hoppity figure 20 after having been energized, is set upon a guide track 30 which confines the forward motion of the figure along a prescribed path indicated by the dashed-line arrow S. In particular, the track 30 is recessed with side edges that channel the locomotive appendages, e.g., the feet, between the edges. Consequently the hopping figure is constrained to move, upon being set upon the track, in a forward direction into the cage 41 of the elevator structure 40. When the cage 41 descends to ground level the hoppity figure 20 is able to exit along a further track as indicated by the dashed-line arrow X.

Figure 2A:
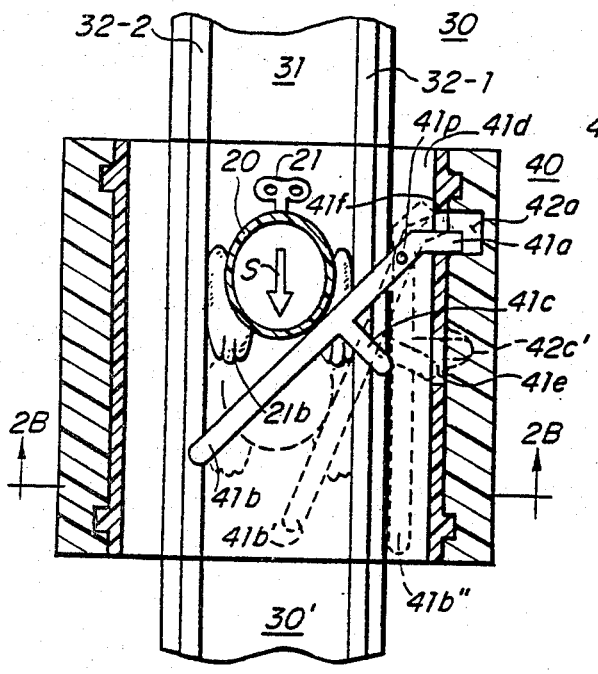
FIG. 2A is a top sectional view of an elevator cage for the system of FIG. 1.
Figure 2B:
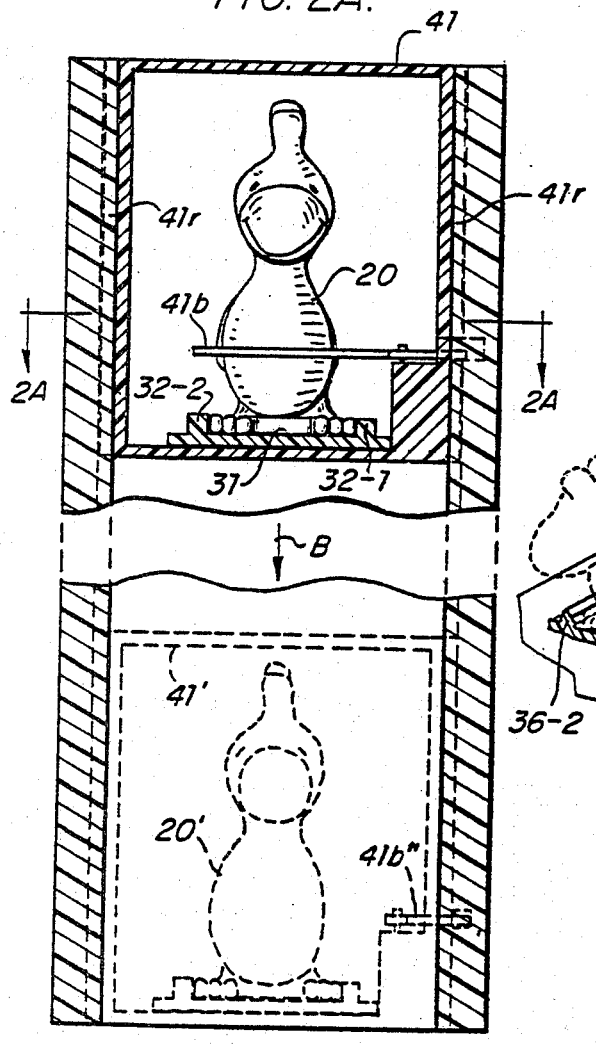
FIG. 2B is a front sectional view of the elevator cage and shaft of FIG. 2A.
Figure 2C:
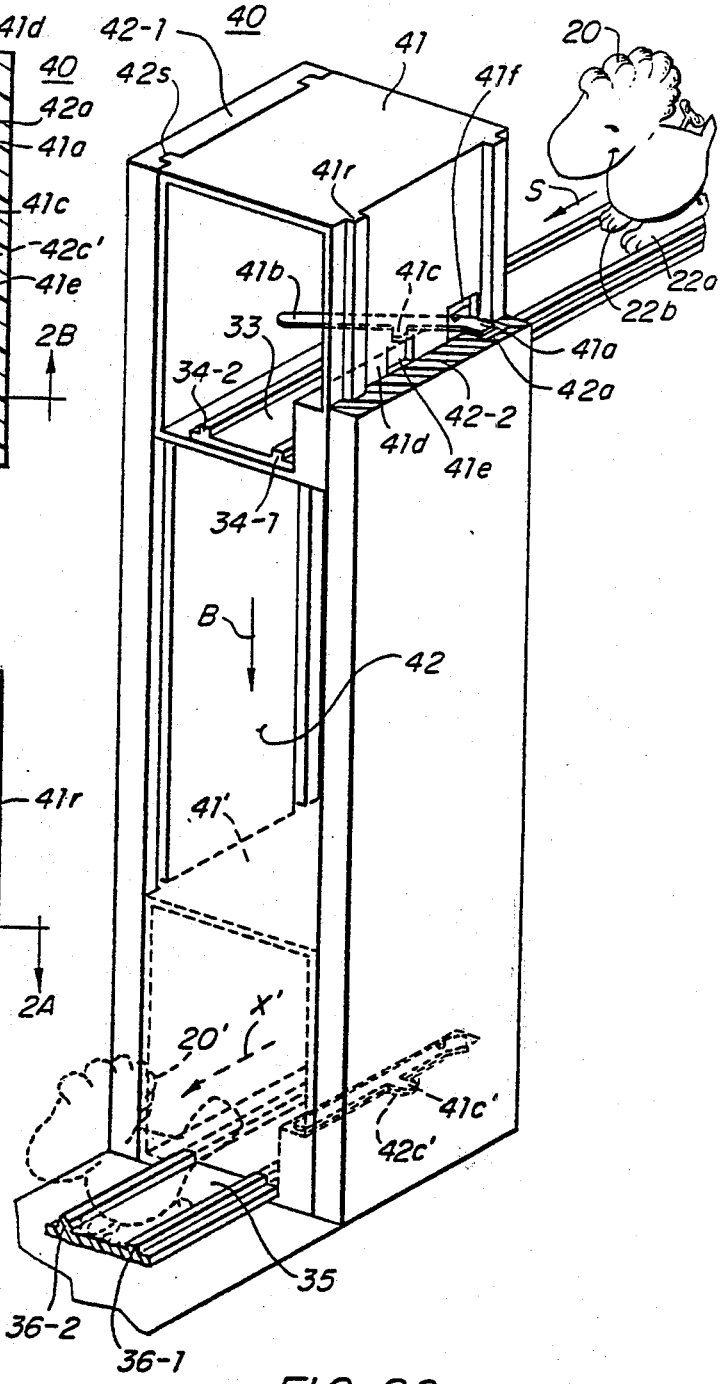
FIG. 2C is a perspective view of the elevator cage and shaft of FIGS. 2A and 2B.

As shown in FIGS. 2A through 2C, the elevator structure 40 is formed by a cage 41 in a shaft 42, with side walls 42-1 and 42-2 (FIG. 2C). Each side wall includes guide slots **42*s*, which are engaged by ridges 41*r* of the cage 41**.

In the upper position 41 the cage is held by the end **41*a* of the control lever 41*b*, which is pivoted on an ledge 41*d* by a pivot 41*p* (FIG. 2A). The control lever extends through an opening 41*f* in the cage 41 to a ledge 42 *a* in the shaft side wall 42-2**.

When the toy 20 hops into the cage 41, after being guided on a platform 31 between side rails 32-1 and 32-2 as shown in FIG. 2A, it moves in the direction indicated by the arrow S and applies pressure against the control lever **41*b*. As indicated in FIG. 2B, the track 30 provided by the platform 31 has side rails 32-1 and 32-2 which are approximately the same height as the feet 22*a* and 22*b* of the figure 20. In an illustrative embodiment, the track 30 had a width of about 1" and the figure 20** had feet about $\frac{1}{8}''$ in heighth. For that combination, stability was achieved for the hopping figure by having the side rails 32-1 and 32-2 at least $\frac{1}{8}''$ in height, up to $\frac{3}{8}''$ in height. In general terms the desired stability is achieved when the side rails are equal to at least the height of the feet but less than three times their height and the width of separation of the side rails of the platform is about eight times the height of the feet. This causes the lever to move in the phantom position 41*b'*, releasing the cage 41 by causing the end 41*a* to pivot off the ledge 42*a* in the aperture 41*f* as indicated in FIG. 2A. In being pivoted, the lever portion 41*c* moves into the aperature 41*e* of the cage 41 (in the phantom 41*b'*), but it cannot move further when the cage is in its upper position 41 because of the side wall 42-2.

However, the release of the cage 41 by the movement of the tip 41*a* off the ledge 42*a* causes it to fall (by gravity) in the direction indicated by the arrow B in FIG. 2C. When the cage reaches its lower position 41' shown in FIGS. 2B and 2C, the control lever 41*b'* *is able to be pivoted further by the pressure of the hoppity figure 20' against it because of a recess 42c'* in the side wall 42-2 as shown in FIG. 2C.

As a result, the control bar 41*b'* moves further to the position 41*b''* shown in FIG. 2A and the lower portion of FIG. 2B. This frees the hoppity figure 20' which is able to exist from the cage along the path of the dashed-line arrow X' in FIG. 2C on the platform 35 between side rails 36-1 and 36-2.

It will be understood that the elevator accessory 40 of FIGS. 2A through 2C is merely illustrative and that a hoppity toy guided in accordance with the invention may be used with a wide variety of other accessories using guide channels which are proportioned to prevent the hoppity figure from leaving the channel and to the hoppity figure as desired. In addition the particular elevator structure of FIGS. 2A through 2C may be used with other kinds of toys.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A hoppity toy system comprising a hoppity toy figure; and means for channelling the motion of said toy in a prescribed way, said figure having feet guided by the channelling means which includes side walls having a height at least equal to but less than three times the height of said feet, and a separation about eight times the height of said feet; wherein the channelling means guides the hoppity toy figure into an auxiliary device, in the form of an elevator including a control lever operated by said hoppity toy figure; said control lever having three distinctive positions.

2. The hoppity toy system of claim No. 1 wherein the channellng means comprises a track which confines the motion of said toy to said prescribed way.

3. The hoppity toy system of claim No. 1 wherein said toy figure is counter-balanced with respect to its feet and releases stored energy when placed on its feet.

4. The hoppity toy system of claim No. 3 wherein the channelling means comprises a track having side rails between which the feet of said figure are confined.

5. The hoppity toy system of claim No. 1 wherein said hoppity toy figure is guided from said auxiliary device.

6. The hoppity toy system of claim No. 1 wherein said control lever is moved from its first position to a second position at an upper level of said elevator, and from said second position to a third position at a lower level of said elevator.

* * * * *